US011001988B2

(12) United States Patent
Gentle et al.

(10) Patent No.: US 11,001,988 B2
(45) Date of Patent: May 11, 2021

(54) CONTROLLING INTERLOCKS BASED ON AN INTERLOCK CONFIGURATION

(71) Applicant: Caterpillar Inc., Deerfield, IL (US)

(72) Inventors: Mike C. Gentle, Maroa, IL (US); Jeremy G. Valeck, Decatur, IL (US); Dustin J. Funk, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 424 days.

(21) Appl. No.: 16/010,577

(22) Filed: Jun. 18, 2018

(65) Prior Publication Data

US 2019/0382983 A1 Dec. 19, 2019

(51) Int. Cl.
*E02F 9/20* (2006.01)
*E02F 3/76* (2006.01)
*E02F 3/84* (2006.01)

(52) U.S. Cl.
CPC ..... *E02F 9/2025* (2013.01); *E02F 3/7604* (2013.01); *E02F 3/7636* (2013.01); *E02F 3/84* (2013.01)

(58) Field of Classification Search
CPC . E02F 3/7636; E02F 3/84; E02F 3/844; E02F 3/7604; E02F 9/2033; E02F 9/2025
See application file for complete search history.

(56) References Cited

U.S. PATENT DOCUMENTS 5,111,901 A * 5/1992 Bachhuber ..... B62D 7/1509 180/415
5,425,431 A * 6/1995 Brandt ..... B60K 28/04 180/273
5,620,194 A * 4/1997 Keeler ..... B62D 61/12 280/81.6
5,711,391 A * 1/1998 Brandt ..... E02F 3/3414 180/273
6,135,230 A * 10/2000 Schenck ..... B60K 28/04 180/269
6,148,688 A * 11/2000 Nishimaki ..... B60K 23/00 180/272
6,212,460 B1 * 4/2001 Rizzo ..... B60T 8/1755 180/197
6,435,053 B1 * 8/2002 Guiet ..... E02F 9/2004 180/271
7,159,684 B2 * 1/2007 Dahl ..... B60K 28/04 180/271
7,192,100 B2 * 3/2007 Berg ..... B60K 28/04 188/18 R
7,235,901 B2 * 6/2007 Bares ..... E02F 9/24 307/326
9,840,826 B2 * 12/2017 Huber ..... B60N 2/787
10,739,767 B2 * 8/2020 Ueno ..... B60W 10/182
(Continued)

*Primary Examiner* — Ramsey Refai
(74) *Attorney, Agent, or Firm* — Harrity & Harrity LLP

(57) ABSTRACT

An automatic interlock system for a motor grader is disclosed. The automatic interlock system may include one or more processors. The one or more processors may be configured to determine an operating mode for the motor grader based on one or more operating parameters of the motor grader. The one or more processors may be configured to determine an interlock configuration for the motor grader based on the operating mode. The one or more processors may be configured to selectively activate or deactivate one or more interlocks of the motor grader based on the interlock configuration.

20 Claims, 3 Drawing Sheets

(56) References Cited

U.S. PATENT DOCUMENTS

| | | | | |
|---|---|---|---|---|
| 2007/0203630 | A1* | 8/2007 | Vitale | B60K 28/04 701/50 |
| 2013/0255977 | A1 | 10/2013 | Braunstein et al. | |
| 2017/0325393 | A1 | 11/2017 | Gschwendtner et al. | |

* cited by examiner

CONTROLLING INTERLOCKS BASED ON AN INTERLOCK CONFIGURATION

TECHNICAL FIELD

The present disclosure relates generally to a motor grader machine and, more particularly, to an automatic interlock system.

BACKGROUND

A motor grader machine may include a transmission coupled to a power source, such as an internal combustion engine or an electric motor to enable the motor grader machine to be repositioned and/or to travel between locations. Additionally, the motor grader machine may include one or more implements to perform one or more functions. For example, the motor grader machine may include a ripper implement to perform a ripping function, a blade implement to perform a blading function, and/or the like.

An inexperienced operator may cause damage to the motor grader machine by attempting to engage (or by accidentally engaging) multiple different functions of the motor grader machine concurrently or by engaging a function of the motor grader machine under incorrect operating conditions. For example, articulating an articulation joint of the motor grader machine while ripping using a ripper implement may result in premature wear to a ripper carriage, a set of ripper shanks, a frame, the articulation joint, a set of articulation cylinders, and/or the like. Similarly, blading or ripping while the motor grader machine is moving between locations at a threshold speed may result in premature wear to a set of cutting edges, a drawbar, a frame, a power train, a ripper assembly, and/or the like. Similarly, blading or ripping while the motor grader is moving in reverse may result in damage to the ripper assembly, the drawbar, and/or the like. Similarly, ripping without a differential lock engaged may cause tire slip, which may result in premature wear to a power train. Similarly, enabling a circle drive to circle when a threshold load is disposed on the motor grader may result in damage to a circle motor. One attempt to prohibit engaging a function of a machine is disclosed in U.S. Pat. No. 6,435,053 that issued to Gulet on Aug. 20, 2002 ("the '053 patent"). In particular, the '053 patent discloses an actuating arrangement that includes an actuating member, a locking arrangement, a movement carrier, and an interlock that can free movement of the carrier. The interlock disclosed in the '053 patent uses a mechanically-defined indication of an operating position of the carrier to prevent the locking bar from being brought into a position in which the actuating member can be activated, thereby locking out a function of a machine.

However, there may be additional factors or parameters that may impact whether an interlock is to be activated for a machine, such as a gear of the machine, a speed of the machine, a status of an implement of the machine, a characteristic of an implement of the machine, a mode of the machine, a skill level of an operator of the machine, and/or the like. The automatic interlock system of the present disclosure solves one or more problems set forth above and/or other problems in the art.

SUMMARY

In one aspect, the present disclosure is related to an automatic interlock system for a motor grader. The automatic interlock system for the motor grader may include one or more processors. The one or more processors may determine an operating mode for the motor grader based on one or more operating parameters of the motor grader. The one or more processors may determine an interlock configuration for the motor grader based on the operating mode. The one or more processors may selectively activate or deactivate one or more interlocks of the motor grader based on the interlock configuration.

In another aspect, the present disclosure is related to a method performed by an interlock control system of a machine. The method may include obtaining sensor data identifying a set of operating parameters of the machine. The method may include determining, based on the set of operating parameters of the machine, an operating mode of the machine. The method may include controlling a set of interlocks of the machine to prohibit access to one or more functions of the machine based on the operating mode of the machine.

In yet another aspect, the present disclosure is related to a machine. The machine may include an engine, a transmission, one or more sensors, and one or more implements. The machine may include at least one of a controller configured to control an implement of the one or more implements, an actuator configured to control the implement of the one or more implements, or an indicator configured to provide information regarding the implement of the one or more implements. The machine may include an interlock control system. The interlock control system may be configured to receive, from the one or more sensors, information regarding at least one of the engine, the transmission, or the one or more implements. The interlock control system may be configured to determine, based on the information, an operating mode for the machine. The interlock control system may be configured to determine an interlock configuration based on the operating mode for the machine. The interlock control system may be configured to selectively activate or deactivate the at least one of the controller, the actuator, or the indicator based on the interlock configuration.

DETAILED DESCRIPTION

This disclosure relates to an automatic interlock system. The automatic interlock system has universal applicability to any machine utilizing such an automatic interlock system. The term "machine" may refer to any machine that performs an operation associated with an industry such as, for example, mining, construction, farming, transportation, or any other industry. As some examples, the machine may be a vehicle, a backhoe loader, a cold planer, a wheel loader, a compactor, a feller buncher, a forest machine, a forwarder, a harvester, an excavator, an industrial loader, a knuckle-boom loader, a material handler, a motor grader, a pipelayer, a road reclaimer, a skid steer loader, a skidder, a telehandler, a tractor, a dozer, a tractor scraper, or other paving or underground mining equipment. Moreover, one or more implements may be connected to the machine and controlled from the automatic interlock system.

Figure 1:
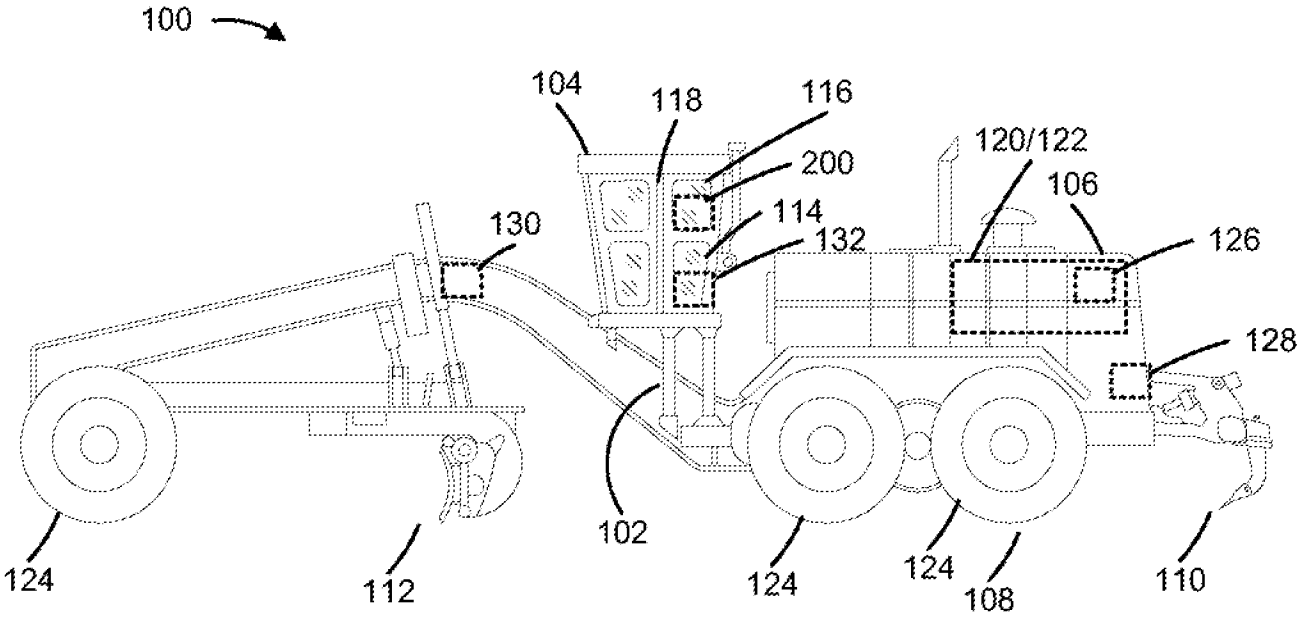
FIG. 1 is a diagram of an example machine that includes an automatic interlock system.

FIG. 1 is a diagram of an example machine 100 that includes an automatic interlock control system 200. The machine 100 is shown as a motor grader but may include any type of machine that includes an automatic interlock system capable of activating and/or deactivating one or more interlocks based on a mode of the machine 100. As shown, machine 100 may have a frame 102 that supports an operator station 104, a power system 106, a drive system 108, a first implement 110, and a second implement 112. The operator station 104 may include operator controls 114 for operating the machine 100 via the power system 106. The illustrated operator station 104 is configured to define an interior cabin 116 within which the operator controls 114 are housed and which is accessible via a door 118.

The power system 106 is configured to supply power to the machine 100. The power system 106 may be operably arranged with the operator station 104 to receive control signals from the operator controls 114 in the operator station 104. Additionally, or alternatively, the power system 106 may be operably arranged with the drive system 108 and/or the implements 110 and/or 112 to selectively operate the drive system 108 and/or the implements 110 and/or 112 according to control signals received from the operator controls 114. The power system 106 may provide operating power for the propulsion of the drive system 108 and/or the operation of the implements 110 and/or 112. The power system 106 may include an engine 120 and a transmission 122.

The drive system 108 may be operably arranged with the power system 106 to selectively propel the machine 100 via control signals from the operator controls 114. The drive system 108 can include a plurality of ground-engaging members, such as wheels 124, as shown, which can be movably connected to the frame 102 through axles, drive shafts, and/or other components. In some implementations, the drive system 108 may be provided in the form of a track-drive system, a wheel-drive system, or any other type of drive system configured to propel the machine 100.

The implements 110 and/or 112 may be operably arranged with the power system 106 such that the implements 110 and/or 112 are selectively movable through control signals transmitted from the operator controls 114 to the power system 106. The illustrated implement 110 is a ripper. The illustrated implement 112 is a blade. Other embodiments can include any other suitable implement for a variety of tasks, including, for example, dozing, brushing, compacting, grading, lifting, loading, plowing, and/or the like. Example implements include dozers, augers, buckets, breakers/hammers, brushes, compactors, cutters, forked lifting devices, grader bits and end bits, grapples, and/or the like.

A rear portion of the frame 102 may include the engine 120 and a transmission 122. The engine 120 may be any type of engine suitable for performing work using the machine 100, such as an internal combustion engine, a diesel engine, a gasoline engine, a gaseous fuel-powered engine, and/or the like. The transmission 122 may transfer power from the engine 120 to the drive system 108 and/or the implements 110 and/or 112. The transmission 122 may provide a number of gear ratios that enable the machine 100 to travel at a relatively wide range of speeds and/or conditions via the drive system 108, and/or that enable the use of the implements 110 and/or 112 to perform work.

In some implementations, the transmission 122 may provide a directional shifting capability (e.g., shuttle shifting and/or the like) that permits the operator to command a machine direction reversal using operator controls 114, such as by shifting a lever and without pressing a brake or an accelerator. The directional shifting capability may permit the operator to command the machine 100 to shift from traveling in a particular direction at a particular speed to an opposite direction at the same speed (e.g., after the machine 100 slows down and reverses direction). In some implementations, engine 120 and/or transmission 122 may be coupled to a control module 126, such as a transmission control module, an engine control module, and/or the like that identifies and/or controls a speed of engine 120, a gear of transmission 122, and/or the like. In some implementations, the control module 126 may receive commands, such as from operator controls 114 to control engine 120 and/or transmission 122. In some implementations, the control module 126 may provide information identifying a status of engine 120 and/or transmission 122.

In some implementations, machine 100 may include sensors 128 and 130. For example, sensor 128 may be a sensor for implement 110, and may take the form of a ripper depth sensor, a rotary sensor, and/or the like. Additionally, or alternatively, sensor 130 may be a sensor for implement 112, and may take the form of a blade in ground sensor, a pressure sensor, and/or the like. In some implementations, sensors 128 and 130 may provide information to implement control module 132, which may control implements 110 and/or 112. In this case, implement control module 132 may receive instructions from operator controls 114 and control implements 110 and/or 112. In some implementations, implement control module 132 may receive instructions from the interlock control system 200, which may automatically lockout one or more functions of implements 110 and/or 112, engine 120, transmission 122, and/or the like.

As indicated above, FIG. 1 is provided as an example. Other examples are possible and may differ from what was described in connection with FIG. 1.

Figure 2:
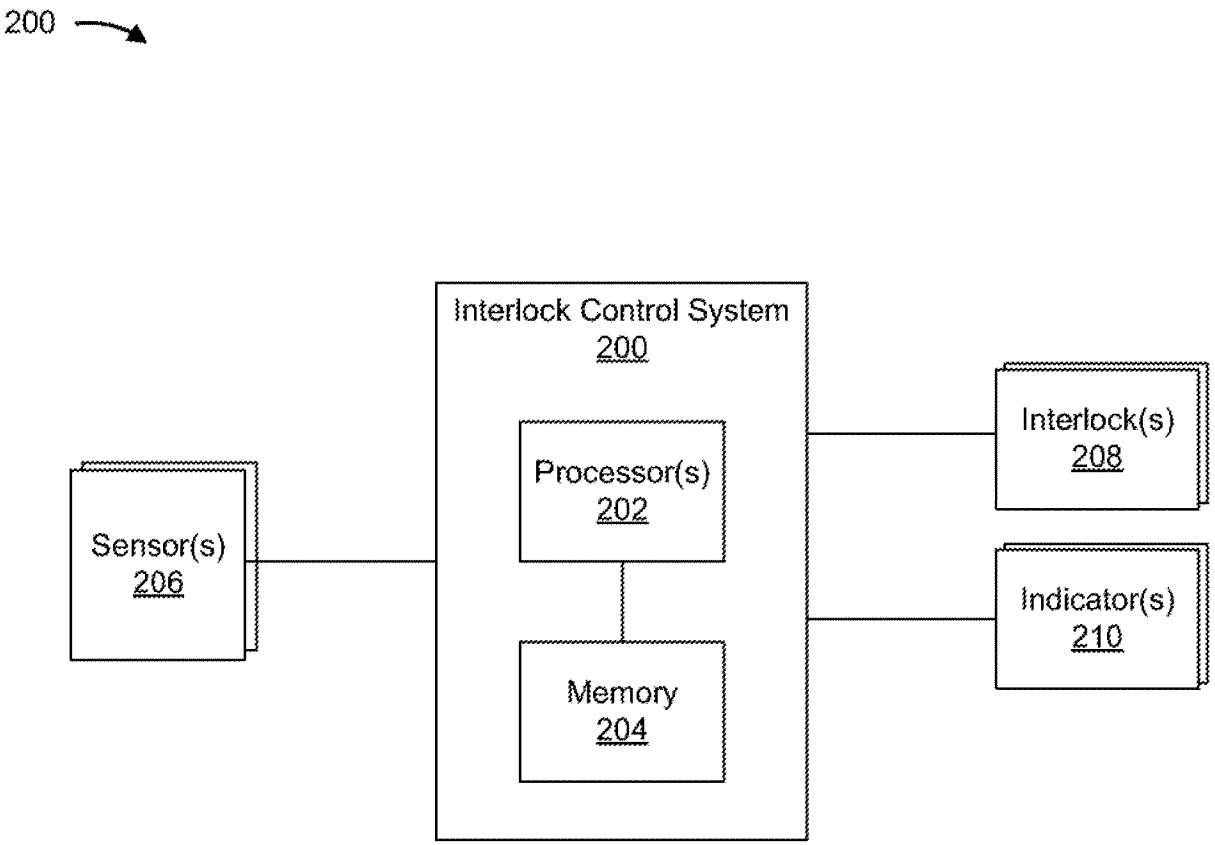
FIG. 2 is a diagram of an example automatic interlock system that may be used with the machine of FIG. 1.

FIG. 2 is a diagram of an example automatic interlock control system 200 and associated components that may interact with the interlock control system 200.

The interlock control system 200 includes one or more processors 202 (e.g., a microprocessor, a microcontroller, a field-programmable gate array (FPGA), an application-specific integrated circuit (ASIC), and/or the like) and memory 204 (e.g., read-only memory (ROM), random-access memory (RAM), and/or the like). In some implementations, the interlock control system 200 may be an electronic control unit of the machine 100. The processor 202 may execute one or more instructions and/or commands to control one or more components of machine 100, such as to automatically activate one or more inactive functions or deactivate one or more active functions of, for example, implements 110 and/or 112. The memory 204 may store program code for execution by the processor 202 and/or for storing data in connection with execution of such program code by the processor 202.

The interlock control system 200 may receive one or more input signals from various components of machine 100, may operate on the one or more input signals to generate one or more outputs signals (e.g., by executing a program using the input signals as input to the program), and may output the one or more output signals to various components of machine 100. For example, the interlock control system 200 may be electronically connected (e.g., via wired or wireless connection) to one or more sensors 206 (e.g., which may correspond to sensors 128 and/or 130), one or more interlocks 208 (e.g., which may correspond to operator controls 114, implement control module 132, and/or the like), one or more indicators 210 (e.g., which may correspond to operator controls 114), and/or the like, and may receive input from the sensors 206, interlocks 208, and/or indicators 210.

Sensors 206 include a set of sensor devices that provide information regarding a status of machine 100. For example, sensors 206 may include a blade in ground sensor, a pressure sensor, a ripper depth sensor, a rotary sensor, a gear sensor, a speed sensor, a blade pitch sensor, a blade sideshift sensor, a circle sideshift sensor, a circle rotation sensor, a load sensor, and/or the like. For example, the load sensor may provide output with which the interlock control system 200 may determine a load (e.g., a drawbar load determined based on an engine torque measurement, an engine speed measurement, a machine speed measurement, a transmission gear measurement, and/or the like). In this case, based on the load satisfying a threshold, the interlock control system 200 may disable circle rotation or reduce circle rotation to avoid damage to a circle drive. In some implementations, sensors 206 may perform a sensor measurement based on a particular trigger, such as based on receiving an instruction from the interlock control system 200, based on expiration of a time threshold, and/or the like. In some implementations, sensors 206 may perform sensor measurements continuously (e.g., in real-time or in near real-time). In this case, the interlock control system 200 may operate with less than a threshold sample time for determining an operating mode of machine 100 and activating or deactivating one or more interlocks 208 for machine 100.

Interlocks 208 include a set of control devices (e.g., controllers, actuators, and/or the like) that control components of machine 100. For example, interlocks 208 may control implements 110 and/or 112, engine 120, transmission 122, and/or the like. In some implementations, interlocks 208 may include a forward gear limiter, a machine speed limiter, a reverse gear lockout, a ripper lower lockout, a circle sideshift lockout, a blade sideshift lockout, a circle rotation lockout, a blade pitch lockout, a blade lower lockout, an articulation lockout, an articulation lower lockout, an automatic differential lockout, a threshold forward gear lockout, and/or the like. In some implementations, interlocks 208 may be a multiple implement lockout (e.g., an element of operator controls 114 that locks out a second implement function when a first implement function is being controlled). In some implementations, interlocks 208 may be associated with a set of discrete states. For example, for a ripper lower lockout, an interlock 208 may be associated with an enabled state wherein a ripper implement is not movable and a disabled state wherein a ripper implement is movable.

Indicators 210 include a set of communication devices to provide information regarding a status of the interlock control system 200. For example, indicators 210 may be a set of light emitting diodes to provide information indicating whether one or more interlocks 208 are activated to lockout a particular function. Additionally, or alternatively, indicators 210 may be a user interface of machine 100 that provides information regarding the status of one or more functions, that provides one or more alerts, and/or the like.

Figure 3:
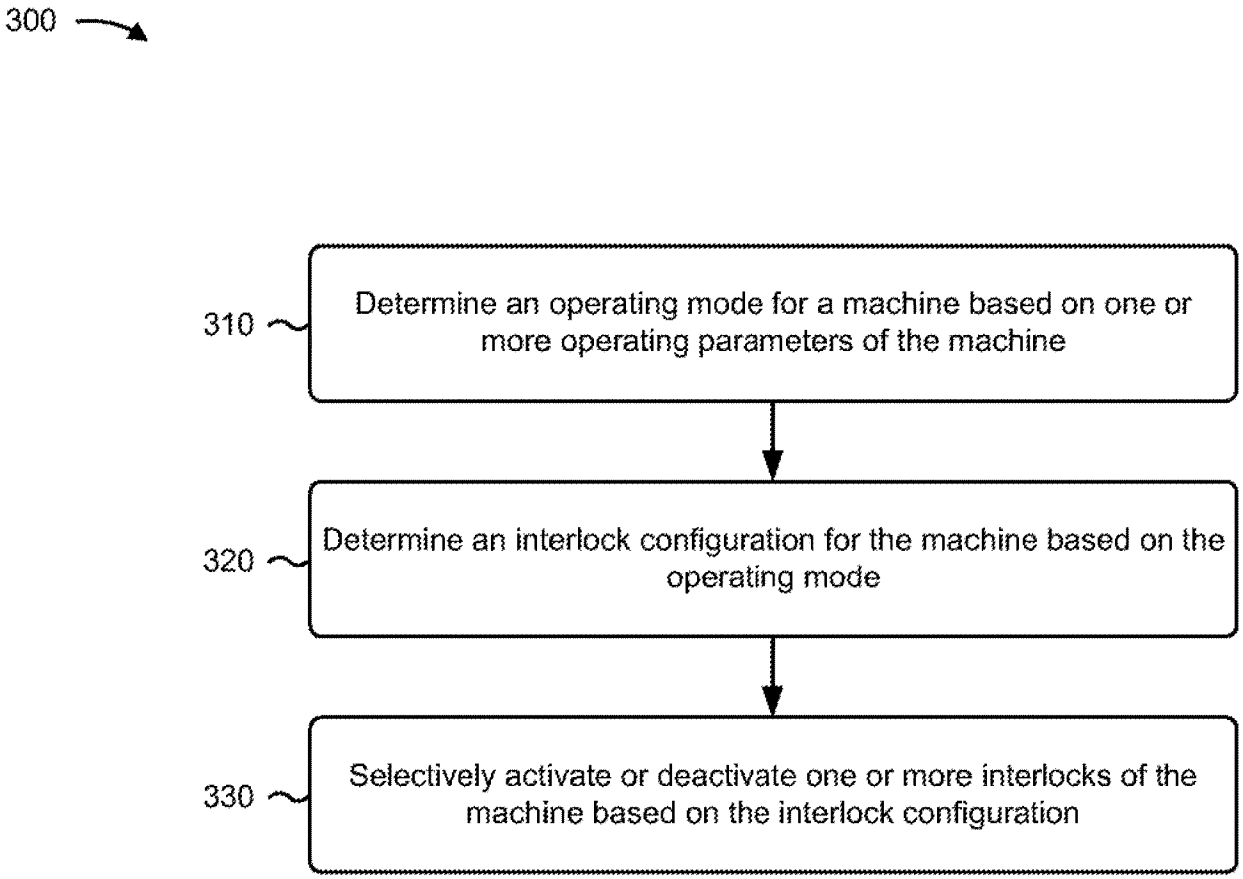
FIG. 3 is a flow chart of an example process for automatically locking out one or more functions of a machine based on an operating mode of the machine.

FIG. 3 is a flow chart of an example process 300 for automatically interlock control for a machine. In some implementations, process 300 may be performed by the interlock control system 200.

As shown in FIG. 3, process 300 may include determining an operating mode for a machine based on one or more operating parameters of the machine (block 310). For example, the interlock control system 200 (e.g., using processor 202 and/or one or more rules stored in memory 204) may determine the operating mode for the machine (e.g., machine 100) based on one or more operating parameters of the machine. In some implementations, the interlock control system 200 may obtain sensor data identifying the set of operating parameters from sensors 206. For example, the interlock control system 200 may obtain sensor data identifying a gear parameter, a speed parameter, a blade status parameter, a ripper status parameter, a blade pitch parameter, a blade sideshift parameter, a circle sideshift parameter, a circle rotation parameter, a load parameter, and/or the like, and may determine that a mode of the machine is a blading mode, a ripping mode, a traveling mode, and/or the like.

As further shown in FIG. 3, process 300 may include determining an interlock configuration for the machine based on the operating mode (block 320). For example, the interlock control system 200 (e.g., using processor 202 and/or one or more rules stores in memory 204) may determine the interlock configuration for the machine based on the operating mode. The interlock configuration may be whether one or more functions are locked out using, for example, interlocks 208. In some implementations, the interlock control system 200 may determine the interlock configuration based on information identifying an operator of the machine. For example, based on receiving, via user input to, for example, operator controls 114 or via a network connection to a data structure storing operator information, information indicating an experience level of an operator, the interlock control system 200 may determine a first interlock configuration. In contrast, for another operator associated with another experience level, the interlock control system 200 may determine a second interlock configuration that is less restrictive than the first interlock configuration. In this way, the interlock control system 200 may differentially apply automatic interlocking to reduce damage caused by inexperienced operators but enable complex utilization of machine 100 by experienced operators.

In some implementations, the interlock control system 200 may determine to activate one or more interlocks 208 of the machine 100 based on the operating mode. In this case, the interlock control system 200 may determine which interlocks 208 to which to provide an instruction to deactivate a function. Additionally, or alternatively, the interlock control system 200 may determine a state for an interlock 208 to deactivate the function or a range of states for the interlock to not permit. As another example, the interlock control system 200 may determine to deactivate one or more interlocks 208 of the machine 100 based on the operating mode. In this case, the interlock control system 200 may determine which interlocks 208 to which to provide an instruction to activate a function. Additionally, or alternatively, the interlock control system 200 may determine a state for an interlock 208 to activate the function or a range of states for the interlock 208 to permit.

As further shown in FIG. 3, process 300 may include selectively activating or deactivate one or more interlocks of the machine based on the interlock configuration (block 330). For example, the interlock control system 200 (e.g., using processor 202 and/or one or more rules stored in memory 204) may selectively activate or deactivate one or more interlocks of the machine based on the interlock configuration. In some implementations, the interlock control system 200 may transmit instructions to an interlock 208 to activate or deactivate the interlock 208 based on the operating mode of the machine. In some implementations, the interlock control system 200 may cause an indicator 210 to indicate a state of the interlock 208 based on transmitting the instructions to the interlock 208 to activate or deactivate the interlock 208. In this way, the interlock control system 200 controls interlocks 208 without intervention by an operator of machine 100.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The interlock control system 200 may be used with any machine 100 that permits an operator to interact with operator controls 114 to utilize functionalities of machine 100. During operation of machine 100, one or more functionalities are automatically locked out using the interlock control system 200 based on an operating mode of machine 100. For example, the interlock control system 200 may determine that an operating mode is a blading mode based on sensor 130 indicating that implement 112 (e.g., a blade) is engaged (e.g., the blade is engaged in the ground). In this case, the interlock control system 200 may lock out a reverse gear function, a ripper lower function, and/or the like. Additionally, or alternatively, the interlock control system 200 may apply a forward gear limitation to limit transmission 122 to less than a threshold gear (e.g., less than 4th gear) or a machine speed limitation to limit engine 120 to less than a threshold speed. Additionally, or alternatively, the interlock control system 200 may restrict operator controls 114 to controlling a single implement of machine 100. Additionally, or alternatively, based on determining that the operating mode is the blading mode, the interlock control system 200 may enable a set of gears of transmission 122 (e.g., first gear to third gear), enable a blade function and a circle function (non-concurrently), and/or the like. In this way, the interlock control system 200 avoids blading at greater than a threshold speed and/or blading in reverse, thereby reducing wear and/or damage to machine 100.

Additionally, or alternatively, the interlock control system 200 may determine that the operating mode is a ripping mode based on sensor 128 indicating that implement 110 (e.g., a ripper) is engaged (e.g., teeth of the ripper are disposed into the ground). In this case, the interlock control system 200 may lock out a reverse gear function, a blade lower function, an articulation function, and/or the like. Additionally, or alternatively, the interlock control system 200 may limit transmission 122 to less than a threshold gear (e.g., less than 2th gear (forward)). Additionally, or alternatively, based on determining that the operating mode is the ripping mode, the interlock control system 200 may activate less than the threshold gear (e.g., first gear), and may enable an automatic differential lock function. In this way, the interlock control system 200 avoids ripping at greater than a threshold speed, ripping in reverse, articulating while ripping, ripping without a differential lock, rotating circle under a threshold load, and/or the like, thereby reducing wear and/or damage to machine 100.

Additionally. or alternatively, the interlock control system 200 may determine that the operating mode is a traveling mode based on a speed threshold (e.g., a speed of machine 100 being greater than, for example, 9 kilometers per hour), a gear threshold (e.g., a gear of transmission 122 being greater than 4th gear (forward)), and/or the like. In this case, the interlock control system 200 may lock out a blade lower function, a ripper lower function, an articulation function, and/or the like. Additionally, or alternatively, the interlock control system 200 may enable, based on determining that the operating mode is the traveling mode, each gear of transmission 122, a wheel lean function, a blade sideshift function, a blade pith function, a circle rotation function, a drawbar centershift function, and/or the like. Additionally. or alternatively, the interlock control system 200 may cause an articulation function to be set to a neutral position. In this way, the interlock control system 200 avoids ripping and/or blading while moving at a threshold speed or moving in reverse, thereby avoiding wear and/or damage to machine 100.

Thus, automatically locking out functions of machine 100 based on an automatic determination of an operating mode of machine 100 may reduce a likelihood of wear and/or damage to machine 100, particularly when machine 100 is operated by an inexperienced operator.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations are possible in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of possible implementations. Although each dependent claim listed below may directly depend on only one claim, the disclosure of possible implementations includes each dependent claim in combination with every other claim in the claim set.

What is claimed is:

1. An automatic interlock system for a motor grader, comprising:

one or more processors configured to:

determine, based on one or more operating parameters of the motor grader, that an operating mode of the motor grader is a first mode of a plurality of modes of the motor grader;

determine a first interlock configuration for the motor grader based on determining that the operating mode is the first mode, wherein the first interlock configuration is different from a second interlock configuration for the motor grader that corresponds to a second mode of the plurality of modes; and selectively activate or deactivate one or more interlocks of the motor grader based on determining the first interlock configuration.

2. The automatic interlock system for the motor grader of claim 1, wherein the one or more processors, when selectively activating or deactivating the one or more interlocks of the motor grader, are configured to:

activate the one or more interlocks of the motor grader based on the interlock configuration.

3. The automatic interlock system for the motor grader of claim 1, wherein the one or more processors, when selectively activating or deactivating the one or more interlocks of the motor grader, are configured to:

deactivate the one or more interlocks of the motor grader based on the interlock configuration.

4. The automatic interlock system for the motor grader of claim 1, wherein the first mode is one of a blading mode, a ripping mode, or a traveling mode.

5. The automatic interlock system for the motor grader of claim 1, wherein the first mode is a blading mode, and wherein the first interlock configuration indicates at least one of: a reverse gear lockout, a ripper lower lockout, a threshold forward gear lockout, a multiple implement lockout.

6. The automatic interlock system for the motor grader of claim 1, wherein the first mode is a ripping mode, and wherein the first interlock configuration indicates at least one of: a reverse gear lockout, a blade lower lockout, an articulation lockout, or a threshold forward gear lockout.

7. The automatic interlock system for the motor grader of claim 1, wherein the first mode is a traveling mode, and wherein the first interlock configuration indicates at least one of: a blade lower lockout, a ripper lower lockout, or an articulation lockout based on the traveling mode.

8. A method performed by an interlock control system of a machine, comprising:

obtaining sensor data identifying a set of operating parameters of the machine;

determining, based on the set of operating parameters of the machine, that an operating mode of the machine is a first mode of a plurality of modes of the machines; and controlling a set of interlocks of the machine to prohibit access to one or more functions of the machine based on determining that the operating mode is the first mode, wherein the set of interlocks are controlled differently when the operating mode is the first mode than when the operating mode is a second mode of the plurality of modes.

9. The method of claim 8, wherein the sensor data includes sensor data identifying at least one of: a gear parameter, a speed parameter, a blade status parameter, a ripper status parameter, a blade pitch parameter, a blade sideshift parameter, a circle sideshift parameter, a circle rotation parameter, or a load parameter.

10. The method of claim 8, wherein controlling the set of interlocks comprises controlling at least one of: a forward gear limitation, a machine speed limitation, a reverse gear lockout, a ripper lower lockout, a circle sideshift lockout, a blade sideshift lockout, a circle rotation lockout, a blade pitch lockout, a blade lower lockout, an articulation lower lockout, or an automatic differential lockout.

11. The method of claim 8, wherein the machine is a motor grader.

12. The method of claim 8, wherein controlling the set of interlocks comprises:

controlling the set of interlocks to prohibit the machine from articulating while ripping, blading while at a threshold speed, ripping while at the threshold speed, ripping while traveling in reverse, blading while traveling in reverse, rotating circle under a threshold load, or ripping without a differential lock enabled.

13. The method of claim 8, further comprising:

determining a characteristic of an operator of the machine; and wherein controlling the set of interlocks comprises:

controlling the set of interlocks based on determining that the operating mode is the first mode and based on the characteristic of the operator of the machine.

14. The method of claim 8, wherein controlling the set of interlocks comprises:

controlling the set of interlocks without intervention by an operator of the machine.

15. The method of claim 8, further comprising:

determining, based on determining that the operating mode is the first mode, one or more active functions, of a set of functions of the machine, and one or more inactive functions of the set of functions of the machine; and wherein controlling the set of interlocks comprises:

controlling the set of interlocks to disable the one or more inactive functions and to enable the one or more active functions.

16. A machine, comprising:

an engine;

a transmission;

one or more sensors;

one or more implements;

at least one of: a controller to control an implement of the one or more implements, an actuator to control the implement of the one or more implements, or an indicator to provide information regarding the implement of the one or more implements;

an interlock control system, wherein the interlock control system is configured to:

receive, from the one or more sensors, information regarding at least one of: the engine, the transmission, or the one or more implements;

determine, based on the information, that an operating mode of the machine is a first mode of a plurality of modes of machine;

determine a first interlock configuration based on determining that the operating mode is the first mode, wherein the first interlock configuration is different from a second interlock configuration for the machine that corresponds to a second mode of the plurality of modes; and selectively activate or deactivate the at least one of the controller, the actuator, or the indicator based on determining the first interlock configuration.

17. The machine of claim 16, wherein the one or more implements includes at least one of: a blade or a ripper.

18. The machine of claim 16, wherein the information indicates that a threshold associated with at least one of the one or more sensors is satisfied.

19. The machine of claim 16, wherein the one or more sensors are configured to measure at least one of the engine, the transmission, or the one or more implements.

20. The machine of claim 16, wherein the interlock control system is a continuously operating interlock control system with a sample time of less than a threshold.

* * * * *